US006365094B1

(12) United States Patent
Hinzmann et al.

(10) Patent No.: US 6,365,094 B1
(45) Date of Patent: Apr. 2, 2002

(54) LUBRICATED DIE

(75) Inventors: Gerd Hinzmann, Oakville; Karol Kucharski, Burlington; Rohith Shivanath, Toronto, all of (CA)

(73) Assignee: Stackpole Limited, Mississuaga (CA)

( * ) Notice: Subject to any disclaimer, the term of this patent is extended or adjusted under 35 U.S.C. 154(b) by 0 days.

(21) Appl. No.: 09/495,147

(22) Filed: Jan. 31, 2000

(51) Int. Cl.[7] ..... B22F 3/12
(52) U.S. Cl. ..... 419/38; 425/78
(58) Field of Search ..... 419/38; 425/78

(56) References Cited

U.S. PATENT DOCUMENTS 5,085,828 A * 2/1992 Shain et al. ..... 419/66
5,093,076 A * 3/1992 Young et al. ..... 419/12
5,321,060 A * 6/1994 Oliver et al. ..... 523/220
5,682,591 A * 10/1997 Inculet et al. ..... 419/38
5,698,149 A * 12/1997 Hinzmann et al. ..... 264/120
5,767,426 A * 6/1998 Oliver et al. ..... 75/246
5,993,729 A * 11/1999 Levebvre et al. ..... 419/2

* cited by examiner

*Primary Examiner*—Daniel J. Jenkins
(74) *Attorney, Agent, or Firm*—Jenkens Gilchrist A Professional Corporation

(57) ABSTRACT

A toolset for forming a component from a powdered metal charge includes a die having two zones on the sidewall. Lubricant is applied to one of the zones. The powdered metal charge is initially compressed to an intermediate density and the lubricated zone of the sidewall brought into contact with the partially compressed charge. The charge is then further compressed to a final density.

37 Claims, 3 Drawing Sheets

LUBRICATED DIE

PRIOR RELATED APPLICATIONS

Not Applicable;

FEDERALLY SPONSORED RESEARCH STATEMENT

Not Applicable;

REFERENCE TO MICROFICHE APPENDIX

Not Applicable

FIELD OF INVENTION

The invention relates to methods and apparatus for forming components from a powdered metal charge.

BACKGROUND OF THE INVENTION

The forming of components from powdered metal is well known and widely used. The technique enables complex shapes to be formed to relatively high compacted densities of up to 75% of solid metal, at relatively low cost and with the dynamic mechanical properties of the component approaching those formed from solid metal blanks.

Conventionally, the powdered metal charge is compressed within a die by punches and the compacted component is then sintered in a sintering furnace to provide a durable component. In view of the forces encountered within the die and the flow of powder into the complex shapes defined by the die it is necessary to provide lubrication between the walls of the die and the powdered charge. Such lubrication reduces the frictional forces between the die walls and the powder and also reduces wear in the die.

Typically, the lubricant is incorporated into the powder but it has been found that this limits the upper value of the density that can be attained during compression.

It has also been proposed to lubricate the wall of a die prior to charging, but the lubricant tends to diffuse into the powder charge which is relatively porous. As a consequence, it is not available for lubrication of the die when required and may also produce inconsistencies in the material forming the charge.

A known method to overcome these disadvantages is to compress the powder containing the lubricant to readily attainable densities, typically 6.7–7.0 gm/cc for iron powder and its alloys, and then sintering the partially compressed component to burn off the lubricant contained within the powder. Following sintering, the component is further compressed to achieve a small increase in density for the final component. Such an arrangement does however require dual handling and dual sintering of the component which is generally undesirable.

It is therefore, an object of the present invention to provide a method and apparatus for forming a component from a powdered metal charge in which the above disadvantages are obviated or mitigated.

SUMMARY OF THE INVENTION

In general terms the present invention seeks to overcome the above disadvantages by partially compressing the powdered charge prior to bringing it into contact with the lubricated wall of the die. Accordingly, the powdered charge does not require the lubricant additive and the partially compressed component is not as absorptive of the lubricant as the uncompressed charge.

More specifically, according to one aspect of the present invention there is provided a method of forming an unsintered component from a powdered metal charge. The method comprises the steps of initially compressing the charge in a mold cavity to an intermediate density less than that of a desired final density, and then bringing a lubricated wall of a die into contact with the charge. Subsequently, the charge is compressed to the final density and removed from the die to provide an unsintered component.

Preferably, the lubricated wall of the die is moved into contact with the charge by displacement of the die relative to punches used for compression of the charge and as a further preference is maintained in the die between initial compression and subsequent compression.

According to a further aspect of the invention there is provided a method of forming a component from a powdered metal charge comprising the steps of establishing a mold cavity between an axial wall of a die and radial walls of a pair of opposed punches. The punches are positioned to locate the charge in a first zone of the axial wall of the die and compress the charge while maintaining it in contact with the first zone to an initial density less than a requisite final density. The punches are moved relative to the die to bring a second zone of the axial wall having a lubricant applied thereto in contact with the charge and the punches then compress the charge between the punches to the requisite final density. The compressed charge is then removed from the cavity.

The present invention also relates to a toolset for forming a component form a powdered metal charge. The toolset comprises a die and a pair of punches each slidable relative to the die and cooperating with the die to define a mold cavity. The die has an axial wall with first and second zones axially spaced a long the die. The die is selectively moveable relative to the punches to bring either the first or second zone into contact with a charge contained in said chamber.

BRIEF DESCRIPTION OF THE DRAWINGS

Embodiments of the invention will now be described by way of example only with reference to the accompanying drawings in which.

DESCRIPTION OF THE EMBODIMENTS OF THE INVENTION

Figure 1:
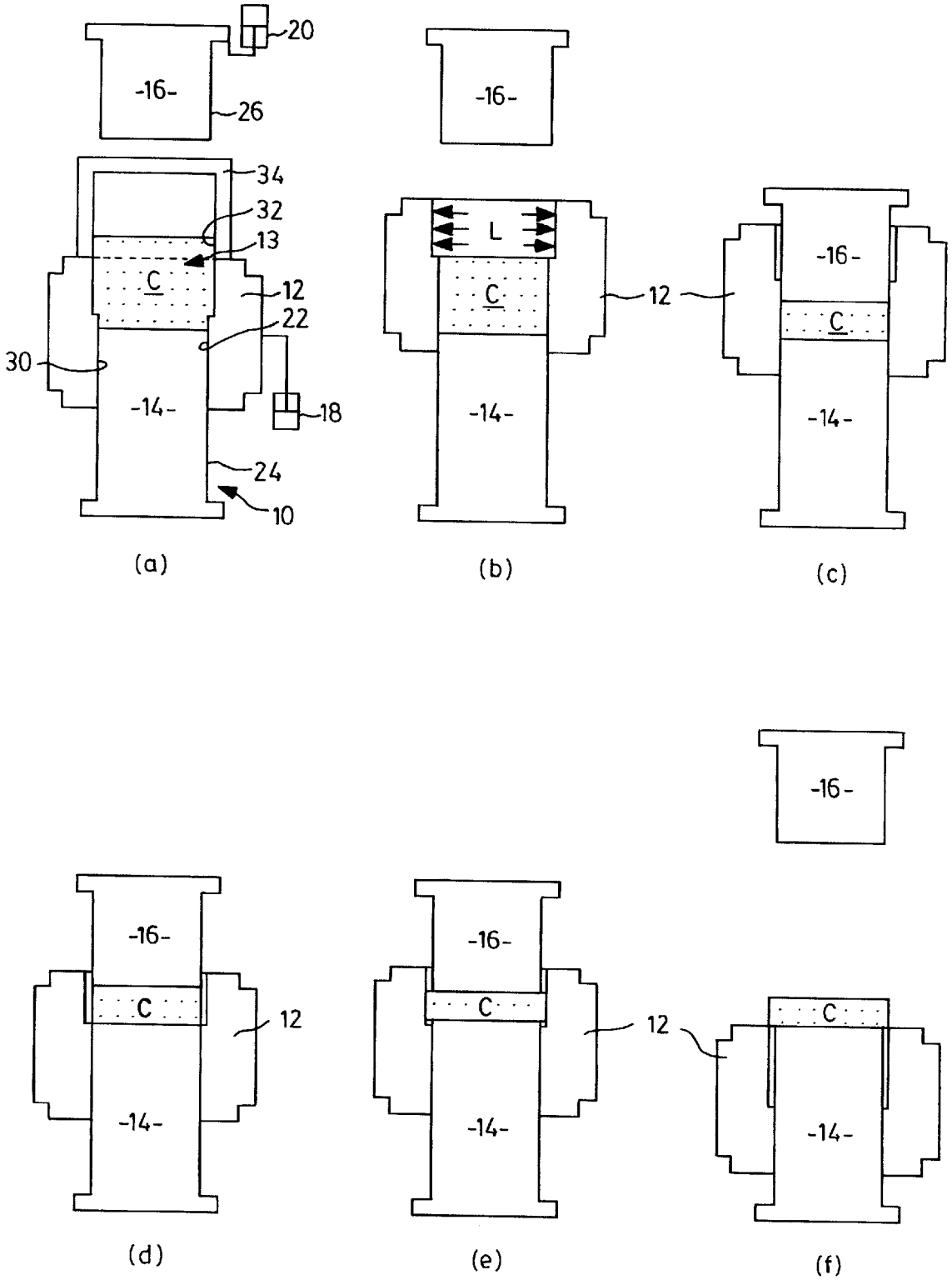
FIGS. 1*a–f* is a schematic representation of a sequence of steps using a first embodiment of the toolset.

Referring, therefore, to FIG. 1, a toolset 10 comprises a die 12 and a pair of punches 14, 16. The punches are slidable within the die and the relative position of the die and punches is controlled by hydraulic cylinders 18, 20. It will be appreciated that the representation of the toolset in FIG. 1 is schematic and that the hydraulic cylinders 18, 20 may be incorporated into a press in which a toolset is located in a conventional manner.

The die 12 includes an axially extending wall 22 that is shaped to define the periphery of a component to be produced. The component, for example, may be a gear having external teeth defined by the axial wall 22. The punches 14, 16 have radially outer surfaces 24, 26 that are complimentary to the surface 14.

The axially extending wall 22 is subdivided into a first zone 30 and a second zone 32, each of which represents an annular band on the wall 22. It will be noted that the portion of the wall 22 defining the second zone 32 is of slightly greater diameter than the first zone to provide a greater radial clearance between the punch 16 and the axial wall 22 in the region of the second zone. As shown in the drawing, this clearance is exaggerated but is sufficient to permit a radial flow of the material as it is compressed in the die.

To form components from a powdered metal charge indicated at C in FIG. 1, a chamber 13 is established by positioning the die 12 so that it projects upwardly above the punch 14. The charge C may be any powdered metal material suitable for high pressure forming of components and will be described in the context of an iron powder and its alloys intended to produce components with properties similar to those of steel. Preferably, the powder is substantially devoid of lubricant with an upper limit of 0.2% by weight of admixed lubricant. The extent of the chamber is sufficient to contain the volume of the charge C in an uncompressed state with surplus material being removable by a wiping motion of the feed system 34. With the chamber filled, as shown in FIG. 1*a,* the die 12 is moved upwardly relative to the punch 16 by the cylinder 18. In this position the charge C is adjacent the first zone 30 of the axial wall with the second zone 32 exposed above the charge as shown in FIG. 1*b*. With the second zone exposed, a lubricant is applied, such as by spraying, as indicated by arrows L, to the second zone 32 of the axial wall 22. The upper punch 16 is then inserted into the die 12 and performs an initial compression of the charge C under the control of the cylinder 20. The initial compression is sufficient to attain a density intermediate that of the final required density and typically might be in the order of 5.5 grams/cc for steel. The initial compression is achieved whilst the charge is in contact with the first zone and, therefore, the lubricant L applied to the second zone is not absorbed by the powder charge C.

After the initial compression as shown in FIG. 1*c,* the die 12 is moved axially by the cylinder 18 to bring the second zone 32 of the axial wall 22 into alignment with the charge C. In this position, the axial wall 22 of the die 12 is lubricated but the partially compressed charge does not have the porosity to absorb the lubricant from the wall. With the die 12 positioned so that the second zone 32 is aligned with the charge C, the upper punch 16 is moved downwardly to effect further compression whilst the die 12 is maintained with the second zone 32 in alignment with the charge. The light radial clearance between the wall 22 and the charge C promotes a radially outward flow of the powder as it is compressed and assists densification. The compression continues until final requisite density is achieved, typically in the order of 93% to 96% of regular density corresponding to a density of 7.3–7.5 gram/cc for iron powder and its alloys to provide physical properties comparable with to those of steel. Thereafter, as shown in FIG. 1F, the die is retracted on the lower punch 14 and the upper punch 16 removed to allow removal of the compressed but unsintered component.

The initial compression is performed to attain a density in which the initial porosity of the charge has been substantially reduced but not so great that the frictional forces have increased to the level where lubricant is necessary. Typically, this will be less than 80% of the regular density, more preferably less than 75% and most preferably in the order of 70% which correspond to densities of 6.2 gm/cc; 5.8 gm/cc and 5.5 gm/cc, respectively for iron powder and its alloys.

It will, of course, be understood that the characteristics of iron powder and its alloys is used as exemplary only and that any powdered metal may be used, such as aluminum and its alloys with a resultant change in the absolute value of the densities at each stage of the process.

Figure 2:
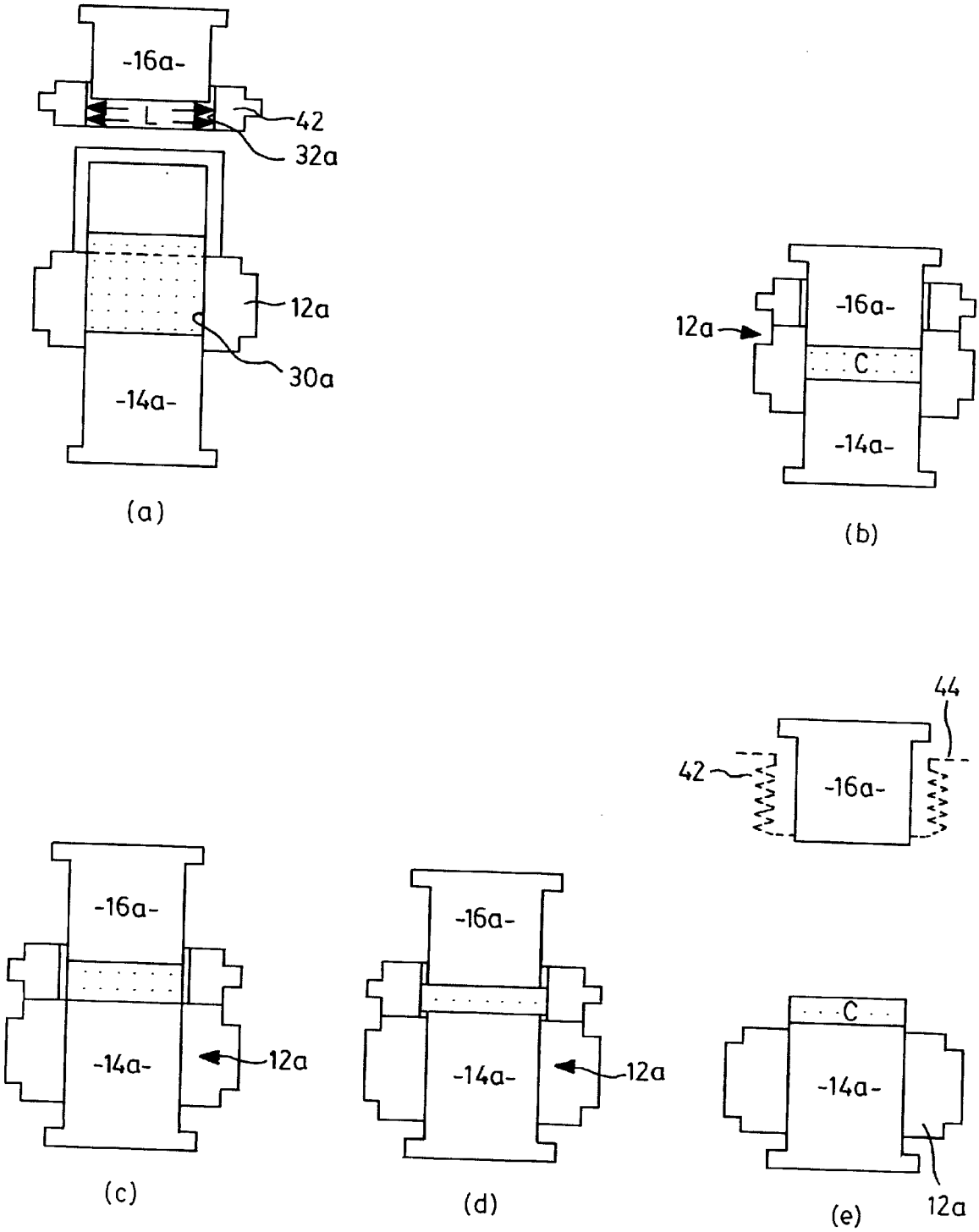
FIGS. 2*a–e* is a schematic representation of the sequential operation of a second embodiment of the toolset.

A second embodiment is shown in FIG. 2 in which like components will be identified with like reference numerals and a suffix 'a' added for clarity. In the embodiment of FIG. 2, the die 12*a* is split into a lower part 40 and an upper part 42. The axial wall 22*a* of the upper part 42 provides the second zone 32*a*. Initially, the two parts 40, 42 of the die 12*a* are separated with the lower punch 14*a* cooperating with the lower part 40 to define a chamber to receive the powder charge C. Whilst the die 12*a* is separated into two parts, a lubricant L is applied to the axial wall of the upper part as indicated by the arrowheads. With the powder located in the chamber, and the lubricant applied to the upper part 42, the two parts 40, 42 of the die 12*a* are brought together with the first zone 30*a* of the axial wall aligned with the charge. Thereafter, the upper punch 16*a* performs a pre-compression as shown in FIG. 2*c* and the die 12*a* is then lowered so that the second zone 32*a* is aligned with the partially compressed charge.

With the die 12*a* repositioned as shown in FIG. 1*d,* the lubricated wall of upper zone 32*a* is adjacent to the charge and further compression from the upper punch 16*a* effects the radial flow and final compression of the powder. Thereafter, the two parts of the die may be separated and the punches removed to permit removal of the compacted component.

In each of the above cases, it will be noted that the lubricant is applied selectively to the wall of the die and the lubricated wall then brought into alignment with the partially compacted charge. In this way, the lubricant is available in the final high pressure compaction but is not in contact with the charge whilst it is in a porous state.

Figure 3:
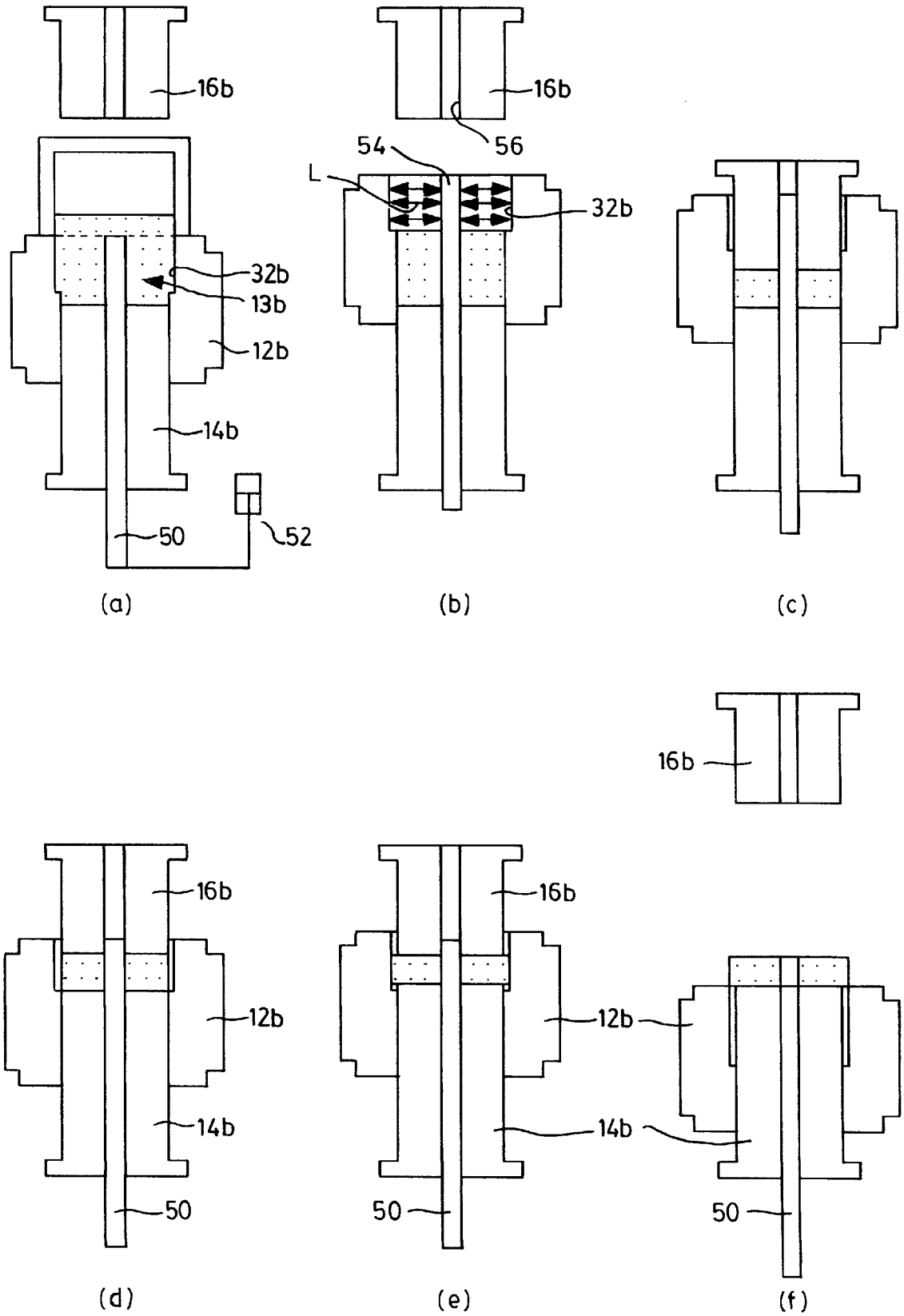
FIGS. 3*a–f* is a schematic representation similar to FIG. 1 of a third embodiment of the toolset.

The technique described above may be used in toolsets utilizing core rods to provide local apertures within the component. As shown in FIG. 3 in which like components are indicated with like reference numerals and a suffix 'b' added for clarity, a core rod 50 extends through the lower punch 14*b* and into the chamber 13*b*. The movement of the core rod 50 is controlled by a cylinder 52 and is initially positioned at or slightly below the level of the charge C. After insertion of the charge C, the cylinder 52 is adjusted so that an upper portion of the core rod, indicated at 54, projects above the charge C. A lubricant is applied to the upper portion 54 and to the second zone 32*b* of the axial wall and the upper punch 16*b* inserted in die 12*b* with a central bore 56 accommodating the core rod 50. Initial compression occurs with the powder charge C out of contact with the lubricated axial walls of the die 12*b* and core rod 50. As shown in FIG. 3*d,* after the initial compression, the die 12*b* and core rod 50 are moved axially to bring the lubricated walls into alignment with the powdered charge. Thereafter, final compression produces the requisite density of the finished component.

The movement of the core rod 50 maybe achieved conjointly with the movement of the die 12*b* by appropriate control of the cylinder 54. Again, it will seem that the lubricated wall of the die and core rod are brought into contact with the compact after initial compression when there is limited porosity.

Alternatively, a toolset similar to that shown in FIG. 2 maybe used with the core rod 50 formed in two parts, each associated with one part of the die, and the tow parts moved conjointly between the initial and subsequent compressions. A one piece core rod could also be used with such an embodiment with the upper portion 54 positioned to project above the charge C prior to assembly of the dies. However, the lubricant would then have to be applied to two distinct zones.

It will be appreciated that the embodiments have been shown in a schematic manner to illustrate the principals applied to the invention and that the surrounding controls and press structure are well known to the person skilled in the art. Naturally, more than one core rod may be incorporated and, if required, multiple punches may be used to achieve a staggered end surface to the component.

If preferred, the upper punch maybe retracted after the initial compression to allow the lubricant to be applied to the axial wall prior to repositioning of the die. The use of the split die and repositioning of the die during the sequential compression permits a further enhancement to be incorporated in the forming process. As shown in ghosted outline in FIG. 2, a heating element 44 may be incorporated into the upper die 42. The heating element 44 maintains the die wall of the upper zone 32*a* at an elevated temperature so that when it moves into contact with the charge C an improved flow and densification is obtained.

Although the preferred embodiments show the use of a single die and punch to attain the sequential compression, it will be appreciated that benefits in the final product maybe obtained by utilizing separate dies and transferring the unsintered compact between the dies. The initial compression is conducted in a first unlubricated die and the compact transferred without sintering to a second die. The second die has lubricated sidewalls and permits the compaction to be completed. If preferred, the second die may also be preheated and maintained at an elevated temperature to assist in the forming process. The same effect maybe achieved by removal of the unsintered partially compressed compact from the die, lubrication of the die and replacement of the compact in the same die.

As a further alternative, a single die maybe used and after initial compression, the upper punch is removed and the die shifted axially to expose an area of the sidewall. Lubricant is then applied and the die repositioned so that the punch can continue to press the compact.

In each of the above alternative, the extra handling and assembly of the dies is believed to be less attractive than the single or split die arrangements shown in the accompanying drawings.

What is claimed is:

1. A method of forming an unsintered component from a powdered metal charge comprising the steps of initially compressing said charge in a mold cavity to an intermediate density less than that of a final density, bringing a lubricated wall of a die into contact with said charge, and subsequently compressing said charge to said final density prior to sintering thereof and removing said compressed charge from said die to provide an unsintered component.

2. A method according to claim 1 wherein said mold cavity is formed between said die and a pair of punches.

3. A method according to claim 2 wherein said lubricant is applied to said die prior to initial compression of said charge to said intermediate density.

4. A method according to claim 3 wherein said charge is maintained in said die between said initial compression and subsequent compression.

5. A method according to claim 3 wherein said lubricated wall of said die is brought into contact with said charge by relative axial displacement between said die and said charge.

6. A method according to claim 5 wherein said charge is maintained within said die between said initial compression and subsequent compression.

7. A method according to claim 5 wherein said die is formed as separable parts and said lubricated wall of said die is provided on one of said parts, said method including the step of applying lubricant to said wall prior to assembly of said die.

8. A method according to claim 7 wherein said charge is placed in a mold cavity formed on the other of said parts prior to assembly of said die.

9. A method according to claim 8 wherein said parts of said die are moved axially conjointly between said initial compression and said subsequent compression.

10. A method according to claim 2 wherein said lubricated wall of said die has an increased radial dimension to promote radial flow of said charge during subsequent compression.

11. A method according to claim 7 including the step of heating said one part of said die.

12. A method according to claim 1 wherein said initial compression produces a component that has a density of less than 80% of said final density.

13. A method according to claim 12 wherein said initial compression produces a component that has a density of less than 75% of said final density.

14. A method according to claim 12 wherein said initial compression produces a component that has a density of less than 70% of said final density.

15. A method of forming a component from a powdered metal charge comprising the steps of establishing a mold cavity between an axial wall of a die and radial walls of a pair of opposed punches, positioning said punches to locate said charge in a first zone of said axial wall of said die, compressing said charge while maintaining it in contact with said first zone to an initial density less than a requisite final density, positioning said punches relative to said die to bring a second zone of said axial wall having a lubricant applied thereto in contact with said charge, compressing said charge between said punches to said requisite final density and removing the compressed charge from said cavity.

16. A method according to claim 15 wherein lubricant is applied to said second zone prior to compression to said initial density.

17. A method according to claim 16 wherein said lubricant is applied after insertion of said charge in said mold cavity.

18. A method according to claim 17 wherein said die is formed from a first part including said first zone of said axial wall and a second part including said second zone of said axial wall, said first and second parts being assembled to define said mold cavity.

19. A method according to claim 18 wherein lubricant is applied to said second zone prior to assembly of said parts.

20. A method according to claim 19 wherein said die is moved axially relative to said punches to bring said second zone of said axial wall into contact with said charge.

21. A method according to claim 15 wherein a core rod is provided in said mold cavity and said method includes the step of lubricating a portion of said core rod that is axially aligned with said second zone and bringing said portion of said core rod into contact with said charge prior to compressing said charge to said requisite final density.

22. A method according to claim 21 wherein said die and said core rod are moved conjointly.

23. A method according to claim 22 wherein said die and a punch are positioned to provide a chamber for said charge and said die is moved axially relative to said punch to expose said second zone after insertion of said charge in said chamber.

24. A method according to claim 23 wherein said chamber is closed by insertion of a second of said punches after lubricant is applied to said wall in said second zone.

25. A method according to claim 15 wherein said second zone is heated.

26. A method according to claim 18 wherein said one part is heated to maintain said second zone at an elevated temperature.

27. A toolset for forming a component from a powdered metal charge, said toolset comprising a die, a pair of punches each slidable relative to said die and cooperating with said die to define a mold cavity, said die having an axial wall with first and second zones axially spaced along said die, a first drive to control relative movement of said punches and a second drive to control movement of said die, said first drive and second drive being conjointly operable to compress a charge in said cavity to an initial density less than a requisite final density whilst maintaining said first zone in contact with said charge and said second drive being independently operable to position said second zone in contact with said charge upon attainment of said initial density, whereby said die is selectively moveable relative to said punches to bring either said first or second zone into contact with a charge contained in said chamber.

28. A toolset according to claim 27 wherein said second zone has a greater radial extent than said first zone.

29. A toolset according to claim 27 wherein said die is formed from a first part including said first zone of said axial wall and a second part including said second zone ofsaid axial wall, said first and second parts being assembled to define said mold cavity.

30. A toolset according to claim 27 including a core rod axially moveable relative to said punches and having a portion thereof coextensive in an axial direction with said second zone of said axial wall.

31. A toolset according to claim 27 including a heater to maintain said second zone at an elevated temperature.

32. A toolset according to claim 29 wherein said one part includes a heater to maintain said second zone at an elevated temperature.

33. A method of forming an unsintered component from a high compressibility iron powder charge having less than 0.2% by weight of admixed lubricant comprising the steps of initially compressing said charge in a mold cavity to an intermediate density less than that of a final density, bringing a lubricated wall of a die into contact with said charge, and subsequently compressing said charge to a final density of greater than 7.3 gm/cc prior to sintering thereof and removing said compressed charge from said die to provide an unsintered component.

34. A method according to claim 33 wherein said compression achieves a final density of between 7.3 and 7.5 gm/cc.

35. A method according to claim 33 wherein said initial compression produces a component that has a density of less than 6.2 gm/cc of said final density.

36. A method according to claim 35 wherein said initial compression produces a component that has a density of less than 5.8 gm/cc.

37. A method according to claim 36 wherein said initial compression produces a component that has a density of less than 5.5 gm/cc.

* * * * *